United States Patent [19]

Heacock

[11] Patent Number: 4,805,969

[45] Date of Patent: Feb. 21, 1989

[54] BAG HOLDER

[76] Inventor: Stephanie Heacock, 74-4 Upper Canada Dr., Willowdale, Ontario, Canada, M2P 2A3

[21] Appl. No.: 58,131

[22] Filed: Jun. 4, 1987

[51] Int. Cl.[4] ..... A47F 1/00

[52] U.S. Cl. ..... 312/50; 206/554; 248/95; 312/291; 312/310; 312/324

[58] Field of Search ..... 312/211, 328, 50, 184, 312/291, 295, 310, 324, 329; 221/45; 206/554; 248/95, 97, 309.2; 292/145

[56] References Cited

U.S. PATENT DOCUMENTS

| | | | |
|---|---|---|---|
| 1,968,271 | 7/1934 | Thornton, Jr. | 312/291 X |
| 2,044,231 | 6/1936 | Smith | 312/50 |
| 2,725,141 | 11/1955 | Latvala et al. | 312/50 X |
| 2,885,086 | 5/1959 | Lawrence | 312/310 X |
| 3,000,549 | 9/1961 | Stange et al. | 206/554 X |
| 3,211,293 | 10/1965 | Tarnoff | 206/554 X |
| 3,603,629 | 9/1971 | Windham | 292/145 |
| 3,869,065 | 3/1975 | Wang | 206/554 X |
| 4,363,405 | 12/1982 | Christie | 206/554 |
| 4,453,649 | 6/1984 | Origuchi | 221/45 X |
| 4,527,693 | 7/1985 | Membrino | 206/554 |

FOREIGN PATENT DOCUMENTS

| | | | |
|---|---|---|---|
| 135323 | 11/1947 | Australia | 312/291 |
| 1539708 | 10/1968 | France | 206/554 |
| A2079249 | 1/1982 | United Kingdom | 206/554 |

*Primary Examiner*—Peter A. Aschenbrenner
*Assistant Examiner*—Thomas A. Rendos

[57] ABSTRACT

A bag holder comprises a generally rectangular housing in which plastic shopping bags having peripheral dimensions larger than those of the housing itself can be stored. The housing has a forward opening and a pair of doors which are hinge-mounted on opposing sides of the opening for movement between open and closed positions. A bag retainer is mounted on a rear wall of the housing and inserts into aligned handles associated with the bags to releasably retain upper bag portions. A bag folding element is hinge-mounted in the interior of the housing for movement between a first position in which the folding element extends through the housing opening and permits lower bag end portions to be rested between the folding element and rear housing wall and a second position in which the folding element folds the lower bag end portions upwardly and is concealed within the housing. The doors can then be closed to fold side edge portions of the bags into the interior of the housing and releasably locked in their closed position to retain the now compacted bags together with the bag folding element.

9 Claims, 3 Drawing Sheets

BAG HOLDER

FIELD OF THE INVENTION

The invention relates generally to devices for storing bags, and more particularly, to a bag holder which in preferred form can be conveniently used in to store in compact form conventional plastic shopping bags such as those commonly provided by grocery and department stores.

BACKGROUND OF THE INVENTION

Retail stores commonly package a customer's purchases in thin plastic bags. These bags are normally formed with apertures in upper end portion thereof to define a pair of handles which permit the customer to carry his purchases. Once the bags are emptied, it is not uncommon for an individual to store these bags for re-use. To the knowledge of the inventor, no convenient device has been made commercially available for storing the bags in compact form and a common practice is simply to stuff the bags into one another and leave the bundled bags in a cupboard or the like. The bags ultimately take up excessive space and individual bags cannot be conveniently retrieved.

A variety of bag storage or handling devices are known. For example, in U.S. Pat. Nos. 3,380,579 and 3,552,697 to Pinto, there are described devices which involve two horizontal hanging rods from which gusseted bags pre-formed with clearance holes for receipt of the rods can be suspended in bulk and an individual bag opened and supported for receipt of groceries or the like. In U.S. Pat. No. 4,062,604 to Popper there is described a trash bag holder which opens and closes a single trash bag in response to the opening and closing of a cupboard door on which the device is mounted. U.S. Pat. No. 2,696,325 to Beier describes a holder in which bags are retained by a spring mechanism and in which pull tabs attached to the bottoms of the bags protrude through an opening associated with the holder to permit withdrawal of the bags individually. U.S. Pat. Nos. 4,527,693 to Membrino and 4,453,649 to Origuchi describe dispensers for bags formed in continuous rolls or stacks which are appropriate for initial dispensing of bags but do not lend themselves conveniently to reuse of bags. Although all such prior patents describe devices which store, handle or dispense bags, none provides a convenient mechanism for storing and dispensing for re-use plastic or other bags of the type commonly provided by retail stores.

BRIEF SUMMARY OF THE INVENTION

In one aspect, the invention provides a bag holder for storing plastic bags or the like which have predetermined peripheral dimensions in a collapsed state and paired handles which are aligned when the bags are collapsed. The holder includes a housing having an opening where the bags can be received, and a pair of doors on opposing sides of the housing opening mounted for hinged or pivoting between open and closed positions relative to housing opening. A bag retainer mounted in the interior of the housing is inserted into the handles associated with the bags or otherwise adapted to releasably retaining upper end portions of the bags. The bag retainer is so positioned and the housing opening has such dimensions relative to the peripheral dimensions of the bags that side portions of the bags extend to either side of the housing opening. A bag folding element is attached to the housing for movement between a first position in which the lower end portions of the bags can be received between the folding element and the housing and a second position in which the folding element folds the lower end portions of the bags upwardly towards the rest of the bags and locates in the interior of the housing. Once the lower end portions of the bags have been folded, the doors associated with the holder can be closed to fold opposing side edge portions of the bags thereby storing the bags in a relatively compact state. Means are provided for releasably maintaining the doors in their closed positions, locking the bag holder until additional bags are to be inserted or bags removed for use.

Various features which can be associated with such a bag holder will be described in greater detail below in connection with the preferred embodiment and various inventive aspects of such bag holders will be more specifically identified in the appended claims.

DESCRIPTION OF THE DRAWINGS

The invention will be better understood with reference to drawings in which.

DESCRIPTION OF PREFERRED EMBODIMENT

Figure 1:
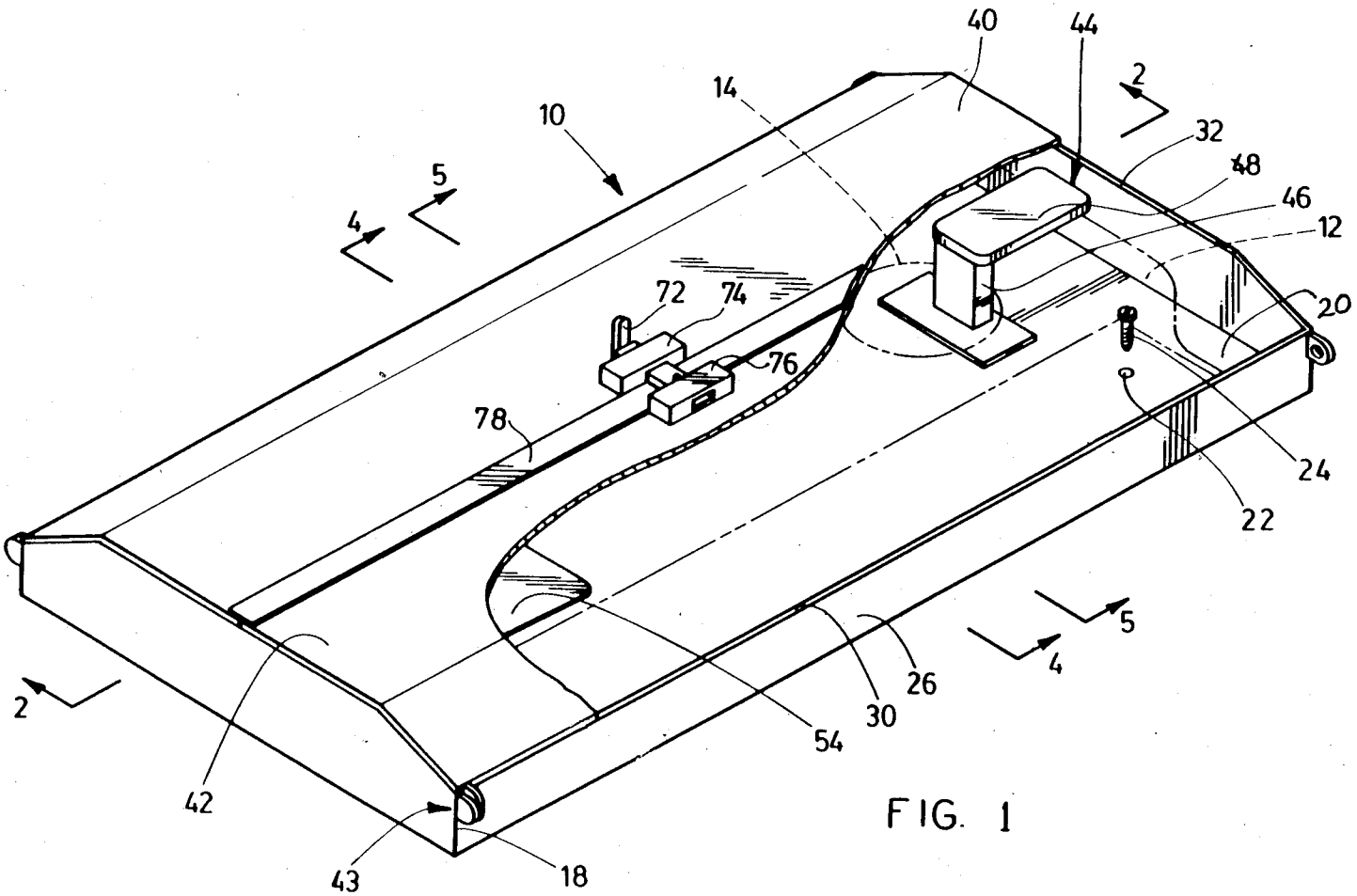
FIG. 1 is a fragmented perspective view of a preferred bag holder.

Reference is made to FIG. 1 which illustrates a preferred bag holder 10 that stores conventional plastic bags such as the bag 12 illustrated in phantom outline in FIG. 1. The bag 12 has a pair of handles with openings 14 that align when the bag is in a collapsed state (as in FIG. 1 where the bag 12 has also been shown folded by the bag holder 10 to a more compact form). It should be noted that in FIGS. 2–5 a multiplicity of bags collectively indicated by the reference numeral 16 have been shown in phantom outline within the holder 10 and that these the bags 16 would have the same general configuration as the bag 12.

The bag holder 10 has a plastic housing 18 which comprises a rear wall 20 formed with a multiplicity of clearance holes (only one clearance hole 22 specifically illustrated in FIG. 1). The bag holder 10 can be fastened in an operative vertical orientation (as in FIG. 2) against a wall (exposed or within a cupboard or the like) by means of screws extended through the clearance holes, such as the screw 24. A generally rectangular, circumferential sidewall 26 extends forwardly from the rear wall 20. The sidewall 26 has forward edges including a pair of opposing vertical edges 28, 30 and upper and lower horizontal edges 32, 34 (when viewed in its operative orientation). The pair of vertical sidewall edges 28, 30 are inset rearwardly from the upper and lower edges 40, 42. The forward edges of the housing sidewall 26 circumscribe and define a generally rectangular opening 36 at the front of the housing 18 where plastic bags can be received or removed. It will be apparent from the drawings that the housing sidewall 26 and housing opening 36 have peripheral dimensions which are less than the peripheral dimensions of the bags intended to be stored therein.

Figure 2:
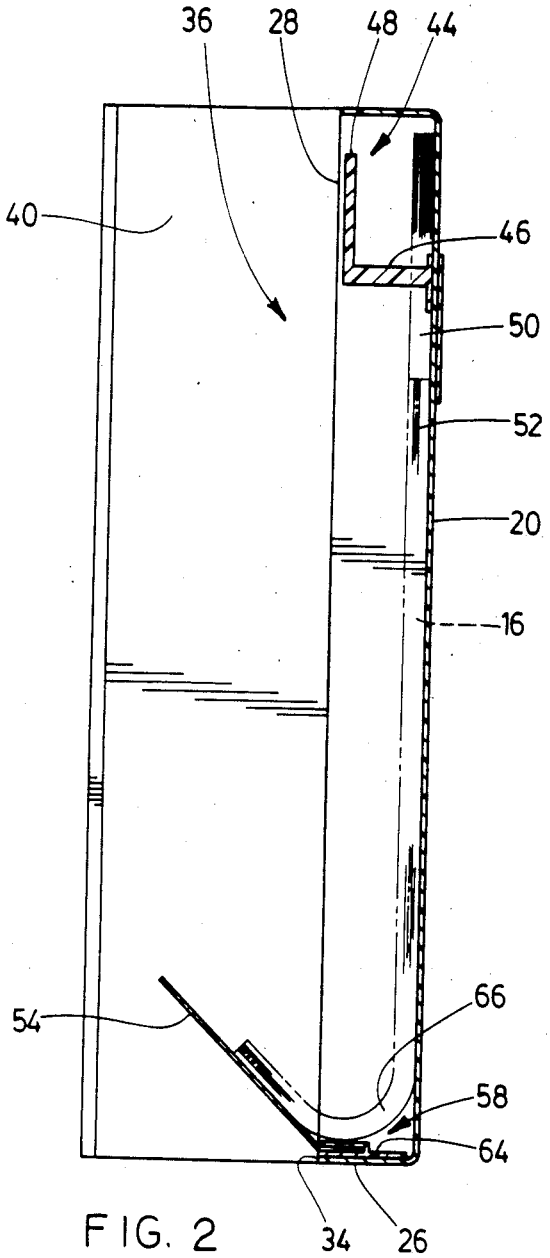
FIG. 2 is a cross-sectional view of the bag holder in a vertical plane with a hinged bag folding element positioned to receive lower end portions of a bag or bags.

The general configuration of a plastic bag retainer 44 associated with the bag holder 10 will be apparent from FIGS. 1 and 2. The bag retainer 44 has a forwardly extending portion 46 and an upwardly extending portion 48 which can be hooked through handle openings 50 associated with the multiplicity of bags 16, as shown in FIG. 2, thereby releasing retaining upper end portions 52 of the bags 16.

Two doors 40, 42 are attached to the housing sidewall 26 on opposing sides of the housing opening 36. The doors 40, 42 are secured by simple hinge joints with hinge axes parallel to the vertical forward edges of the housing sidewall 26. Each joint comprises a pair of lugs integrally molded with the housing sidewall 26 at upper and lower ends thereof and formed with cylindrical recesses. Similar lugs are formed on the doors 40, 42 and are molded with complementary pegs that are received in the recesses. Two such hinge joints associated with the door 42 have been indicated in FIG. 1 with the common reference numeral 43. The doors 40, 42 can accordingly pivot between open and closed positions relative to the housing opening 36 as apparent in the drawings. It should be noted that the insetting of the vertical forward housing edges 28, 30 where the door hinges are located and the provision of vertical bend lines centrally in the doors 40, 42 are largely matters of design and not pertinent to the invention itself.

Figure 3:
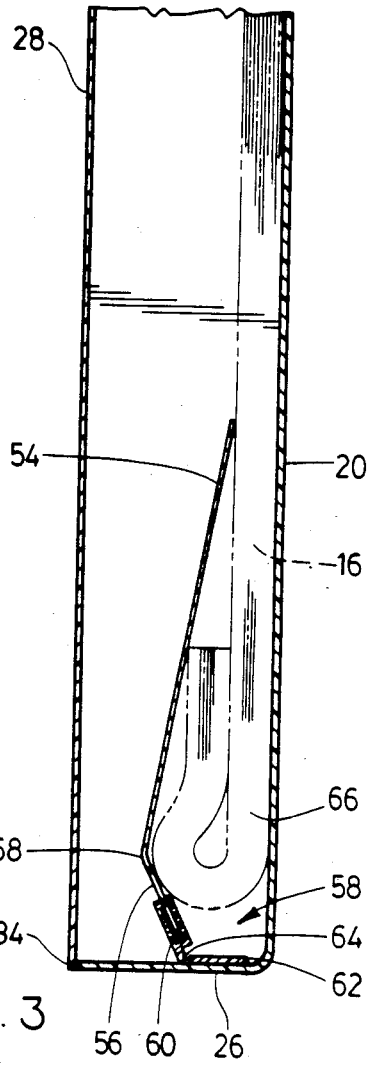
FIG. 3 is an enlarged section of the view of FIG. 2 with the bag folding element positioned in the interior of the housing.
Figure 4:
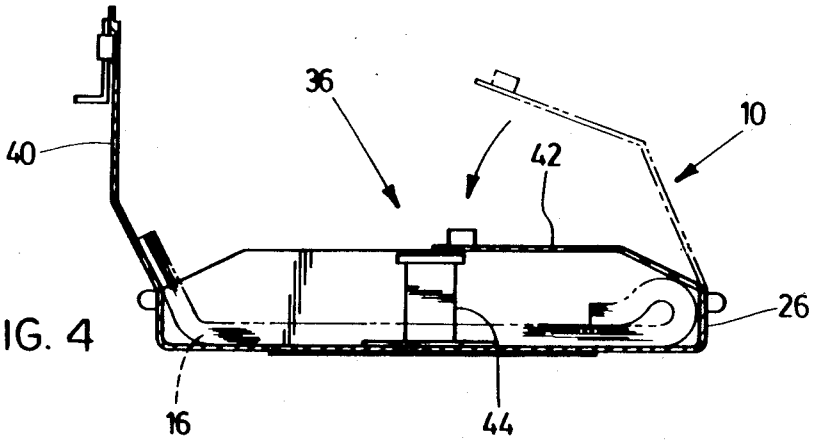
FIG. 4 is a view along the lines 4—4 of FIG. 1 with one door associated with the holder shown in an open orientation; and, FIG. 5 is a view along the lines 5—5 of FIG. 1.

A bag folding element 54 associated with the bag holder 10 and formed from a sheet of plastic material is illustrated in FIGS. 1, 2 and 3. As will be apparent in FIGS. 2 and 3, a lower end portion 56 of the folding element 54 is hingedly connected to the bottom of the housing 18 by means of an integrally molded hinge 58. The hinge 58 comprises a pair of toothed longitudinal gripping jaws 60 (shown in transverse cross-section in FIGS. 2 and 3) and a base strip 62 which is adhesively secured to the bottom of the housing 18. A longitudinal recess 64 in the base strip 62 permit pivoting of the gripping jaws 60 relative to the adhesively-secured portions of the base strip 62. The pair of gripping jaws 60 which are sufficiently resilient to deflect to receive and then retain lower edge portions of the folding element 54. The exact hinge means or other means used to mount the folding element for movement relative to the housing 18 is not a critical aspect of the present invention, and in particular, it would be appropriate to form a hinge connection between the folding element 54 and the housing 18 using hinge joints similar to the joints 43 associated with the doors 40, 42.

The folding element 54 can be moved in a pivoting or hinged fashion between the positions illustrated in FIGS. 2 and 3. In a first position illustrated in FIG. 2, the folding element 54 extends forwardly and outwardly through the housing opening 36 and permits the lower end portion 66 of bags 16 inserted into the housing 18 to assume a generally L-shaped configuration between the folding element 54 and the rear housing wall as shown in FIG. 2. The folding element 54 can then be pivoted upwardly to a second position illustrated in FIG. 3 in which the lower bag end portions are folded upwardly towards the rest of the bags 16 and in which the folding element 54 is located within the interior of the housing 18. A bend 68 formed in the folding element 54 intermediate its upper and lower end portions ensures that the folding element 54 is entirely within the housing 18 in this second orientation.

Figure 5:
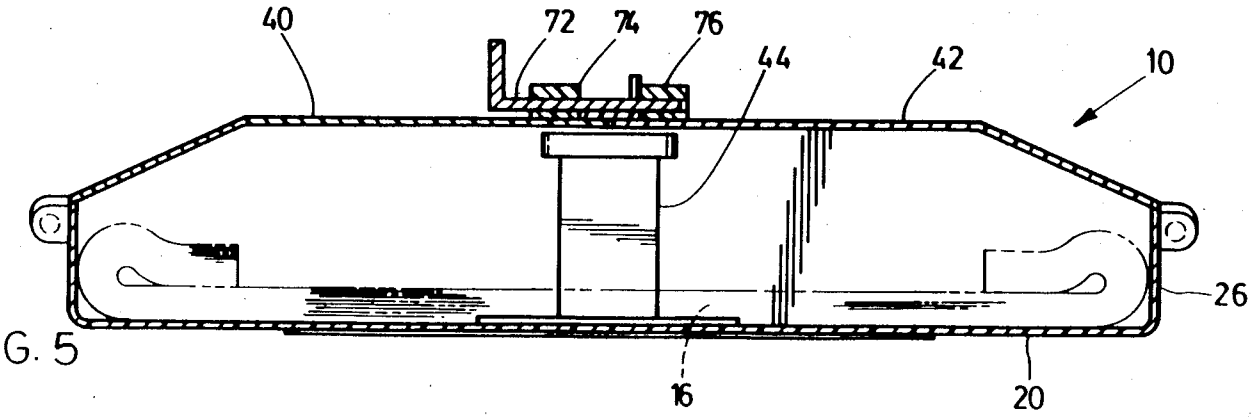

The manner in which bags 16 are inserted into the housing 18 and compacted will be described with reference to the various drawings. Assuming, for example, that the multiplicity of bags 16 illustrated in FIGS. 2–5 were to be inserted into the housing 18, the paired and aligned openings of the various bags 16 would first be inserted over the bag retainer 44 substantially as shown in FIG. 2. The lower end portions of the bags 16 would then be positioned in a generally L-shaped configuration between the folding element 54 and the rear housing wall as in FIG. 2. The folding element 54 would then be raised upwardly to fold the lower bag portions into a more compact form substantially as illustrated in FIG. 3. Due to the relative peripheral dimensions of the bags 16 and the housing opening 36 and the position of the bag retainer 44 along a central vertical axis of the housing 18, opposing side portions of the bags 16 would extend outwardly from the housing opening 36 by equal amounts onto the doors 40, 42 in substantially the relationship illustrated with respect to the door 40 in FIG. 4. Each of the doors 40, 42 can then be moved in a hinged or pivoting manner to a closed position substantially as illustrated in FIG. 5 in which the opposing side portions of the bags 16 are folded over the bags 16 themselves.

A simple locking mechanism is provided to maintain the two doors 40, 42 in their closed position. The locking mechanism comprises a latch 72 that slides in slots (illustrated but not indicated) in two plastic blocks 74, 76 attached to the doors 40, 42 and aligned when the doors 40, 42 are in their closed position. The latch 72 immediately confronts an edge strip 78 attached to the door that spans the gap between the two doors 40, 42 in the closed orientation. In their closed positions, each of the doors is positioned to engage the folding element 54 to obstruct outward movement of the folding element 54 under gravity or in response to the tendency of the bag 16 to unfold and the door locking mechanism ensures that the folding element 54 cannot in fact open the doors 40, 42 until the locking mechanism is released. This arrangement is particularly advantageous as no special biasing means or additional locking mechanism is required to maintain the folding element in its bag folding and retaining position and the cost of manufacturing the bag holder 10 is therefore considerably reduced.

Individual bags can be removed essentially by reversing the process by which they are inserted and retained in the housing 18.

It will be appreciated that a particular embodiment of the invention has been described for purposes of illustrating the principles of the invention and that modifications may be made from the particular design shown without departing from the spirit of the invention or the scope of the appended claims.

I claim:

1. A bag holder comprising:

a housing having an opening through which bags are both inserted into and removed from the interior of the housing;

a first door mounted to the housing to one side of the housing opening for pivoting movement between open and closed positions relative to the housing opening;

a second door mounted to the housing to an opposite side of the housing opening for pivoting movement between open and closed positions relative to the housing opening;

manually-operable locking means for releasably locking and maintaining the doors in their closed positions, the locking means being releasable to permit the doors to be repeatedly pivoted between their open and closed positions for introduction and removal of bags through the housing opening, the locking means permitting the doors to be repeatedly locked in their closed positions;

a bag retainer mounted in interior of the housing and accessible through the housing opening, the bag retainer being positioned to engage each of the bags as each bag is inserted through the housing opening into the interior of the housing and adapted to releasably retain an upper end portion of each bag upon such engagement, the bag retainer permitting each of the bags to be repeatedly engaged with and disengaged from the bag retainer;

means for folding the bags when the bags are retained by the bag retainer and the doors have been pivoted to their open positions, the bag folding means comprising a bag folding element and means mounting the bag folding element to the housing for movement between a first position in which the bag folding element extends outwardly through the housing opening and a second position in which the bag folding element is located in the interior of the housing, the bag folding element folding lower end portions of retained bags upwardly towards the rest of the retained bags as the bag folding element is moved from the first position to the second position.

2. A bag holder as claimed in claim 1 in which at least one of the doors is positioned in its closed position to engage the folding element to obstruct movement of the folding element to its first position.

3. A bag holder as claimed in claim 1 in which the bag retainer is adapted to be inserted through a pair of aligned handles associated with the bags.

4. A bag holder as claimed in claim 3 comprising hinge means securing the folding element to the housing for hinged movement between the first and second positions.

5. A bag holder for storing bags which in a collapsed state have predetermined peripheral dimensions, each bag having a pair of handles at a upper end portion of the bag, the handles have holes which are aligned when the associated bag is collapsed, the bag holder comprising:

a housing having a rear wall and a generally rectangular sidewall extending forwardly from the rear wall and defining a generally rectangular forward opening through which the bags are both inserted into and removed from the interior of the housing;

a first door mounted to the housing to one side of the housing opening for pivoting movement between open and closed positions relative to the housing opening;

a second door mounted to the housing to an opposite side of the housing opening for pivoting movement between open and closed positions relative to the housing opening;

manually-operable locking means for releasably locking and maintaining the doors in their closed positions, the locking means being releasable to permit the doors to be repeatedly pivoted between their open and closed positions for introduction and removal of bags through the housing opening, the locking means permitted the doors to be repeatedly locked in their closed positions;

a bag retainer mounted in interior of housing and accessible when the doors are pivoted to their open positions, the bag retainer being positioned for insertion into the aligned holes of the handles of each bag as each bag is inserted through the housing opening into the interior of the housing thereby releasably retaining the bags, the bag retainer being so positioned and the housing opening having such dimensions relative to the peripheral dimensions of the bags in the collapsed state that opposing side portions of each retained bag extend beyond the housing sidewall to the one side of the housing opening and to the opposite side of the housing opening when each bag is retained by the bag retainer, the bag retainer being repeatedly insertable into and removable from the handles of each bag;

means for folding the bags when the bags are retained by the bag retainer and when the doors are pivoted to their open positions, the bag folding means comprising a bag folding element and means mounting the bag folding element to the housing for movement between a first position in which the bag folding element extends outwardly through the housing opening and second position in which the bag folding element is located in the interior of the housing, the bag folding element folding lower end portions of the bags retained by the retaining member upwardly towards the rest of the retained bags as the bag folding element is moved from the first position to the second position;

the first door folding the one of the opposing side portions of each retained bag towards the rest of the bags during movement from its open position to its closed position, and the second door folding the other of the opposing side portions of each retained bag towards the rest of the bags during movement from its open position to its closed position, after the bag folding element folds the lower end portions of the bags upwardly and locates within the housing.

6. A bag holder as claimed in claim 5 in which at least one of the doors is positioned in its closed position to engage the folding element to obstruct movement of the folding element to its first position.

7. A bag holder as claimed in claim 6 comprising hinge means securing the folding element to the housing for hinged movement between the first and second positions.

8. A bag holder for storing bags, each bag having a pair of handles located at an upper end portion of the bag, the pair of handles being be aligned when the associated bag is collapsed, comprising:

a housing having a rear wall and a generally rectangular sidewall extending forwardly from the rear wall and defining a generally rectangular forward opening through which the bags are both inserted into and removed from the interior of the housing;

at least one door mounted to the housing for hinged movement between open and closed positions relative to the housing opening;

manually-operable locking means for releasably locking and maintaining the at least one door in its closed position, the locking means being releasable to permit the at least one door to be repeatedly pivoted between its open and closed positions for introduction and removal of bags through the housing opening, the locking means permitting the at least one door to be repeatedly locked in its closed position;

a bag retainer mounted in the interior of housing and accessible through the housing opening, the bag retainer being positioned for insertion into the aligned handles of each of the bags as each bag is inserted into the interior of the housing through the housing opening thereby releasably retaining the upper end portion of each inserted bag, the bag retainer being repeatedly insertable and removable from the aligned bag handles of each bag such that the bags can be repeatedly stored and removed from the housing;

means for folding the bags when retained by the bag retainer, the bag folding means comprising a bag folding element and means mounting the bag folding element to the housing for movement between a first position in which the bag folding element extends outwardly through the housing opening and second position in which the bag folding element is located in the interior of the housing, the bag folding element folding lower end portions of the retained bags upwardly towards the rest of the retained bags as the bag folding element is moved from the first position to the second position; and, the at least one door engaging the folding element in the closed position to obstruct movement of the folding element to its first position thereby maintaining the retained bags in the interior of their housing in their folded state.

9. A bag holder as claimed in claim 8 comprising hinge means securing the folding element to the housing for hinged movement between the first and second positions.

* * * * *